United States Patent [19]

Miyamoto

[11] 4,132,138

[45] Jan. 2, 1979

[54] CUTTER FOR A CUTTING MACHINE

[75] Inventor: Eiji Miyamoto, Kanazawa, Japan

[73] Assignee: Marumiya Shoko Co., Ltd., Toyama, Japan

[21] Appl. No.: 791,682

[22] Filed: Apr. 28, 1977

[51] Int. Cl.[2] ..... B26D 1/08

[52] U.S. Cl. ..... 83/697; 83/925 A

[58] Field of Search ..... 83/697, 925, 925 A; 144/186

[56] References Cited

U.S. PATENT DOCUMENTS

| | | | |
|---|---|---|---|
| 604,813 | 5/1898 | Ward | 144/186 |
| 3,509,790 | 5/1970 | Hoppe | 83/697 |
| 3,528,332 | 9/1970 | Thumim | 83/925 A |

*Primary Examiner*—Donald R. Schran

*Attorney, Agent, or Firm*—Stevens, Davis, Miller & Mosher

[57] ABSTRACT

A cutter for a cutting machine wherein a large number of inclined grooves having an angle relative to the edge of the cutter are formed in parallel on the rear side of the cutter, whereby the job of cutting stacked sheets of paper into book blocks of a predetermined size and the job of forming groove portions at the back parts of the book blocks can be simultaneously executed in the production of brochures.

2 Claims, 7 Drawing Figures

FIG. 4
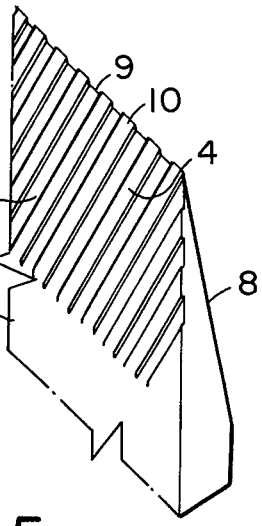
FIG. 5
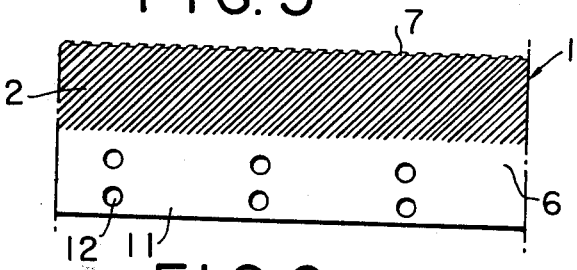
FIG. 6
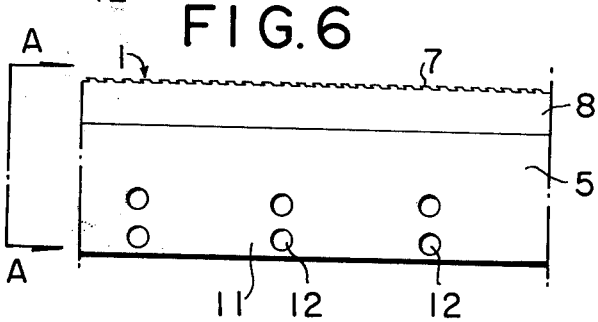
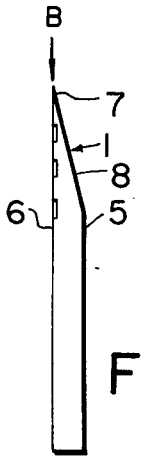
FIG. 7

CUTTER FOR A CUTTING MACHINE

BACKGROUND OF THE INVENTION

This invention relates to a cutter which is mounted on a cutting machine for cutting stacked sheets of paper into book blocks of a predetermined size such as B5 size and A4 size in the production of the so-called brochures including notebooks, various publications, telephone directories, etc.

BRIEF SUMMARY OF INVENTION

Objects of this invention are to form groove portions at the back part of a brochure to which supporting paper is to be stuck, to make it possible to simultaneously carry out the formation of the groove portions and the cutting of stacked sheets of paper into a predetermined size, and to provide a cutter which can accordingly enhance the production efficiency of the brochure.

This invention is directed to a cutter for use in producing a brochure which is formed with groove portions at the back part thereof and in which supporting paper is stuck to the groove portions with a bonding agent.

In the case of producing a brochure having groove portions at the back part thereof, there have heretofore been employed two kinds of cutters; a cutter for cutting stacked sheets of paper into a book block of a predetermined size, and a cutter having a groove-shaped blade for forming the groove portions at the back part of the book block. In order to form the brochure, the prior art requires the use of two kinds of cutters and needs two steps to complete the job, so that the production efficiency is lowered and more labor is necessary.

BRIEF DESCRIPTION OF THE DRAWINGS

Other features and advantages of this invention will become apparent from the following description taken with reference to the accompanying drawings, in which:

FIG. 4 is an enlarged perspective view of a blade in the cutter of this invention, FIG. 5 is a rear view of the cutter of this invention, FIG. 6 is a front view of the cutter of this invention, and FIG. 7 is a side view as seen in a direction A—A in FIG. 5.

As shown in FIG. 1, a cutting machine on which the cutter of this invention is mounted may be any of generally known ones. Mainly used is a cutting machine equipped with a table (T) on which stacked sheets of paper are placed, a push-out member which pushes out the sheets of paper towards a cutter, a holder (H) which holds down the sheets of paper under the cutter, a member (M) to which the cutter is attached, and a driving mechanism (C) which moves the cutter up and down in an oblique direction. This invention is especially directed to features in the cutter which is mounted on such cutting machine, and it is preferred to use a cutting machine of a construction capable of freely adjusting the angle of the oblique upward and downward motions of the cutter.

As shown in FIGS. 2, 3 and 4, a cutter 1 is formed with a large number of grooves 2 at suitable intervals in the thickness direction or on the rear side 6 thereof. The grooves 2 extend from substantially the central part of the rear side towards the edge of a blade 7 in a manner to incline at a suitable angle relative to the face of the blade.

Figure 1:
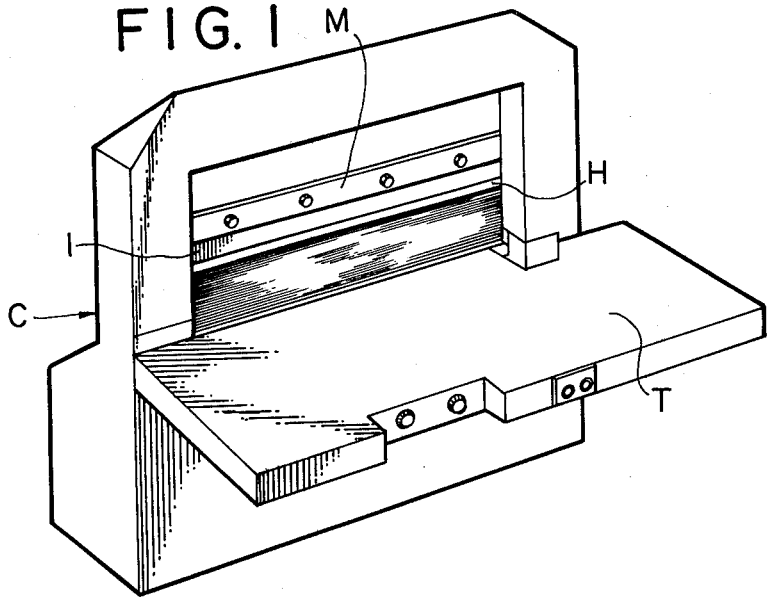
FIG. 1 is a perspective view of a cutting machine with the cutter of this invention mounted thereon.
Figure 2:
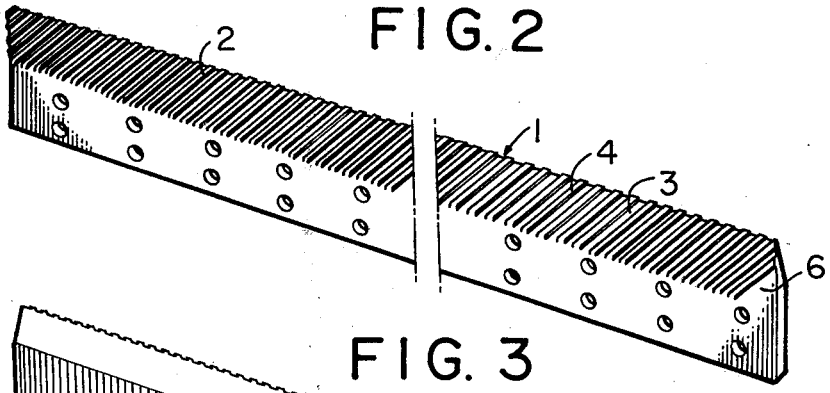
FIG. 2 is a perspective view of the cutter of this invention as seen from the rear side.
Figure 3:
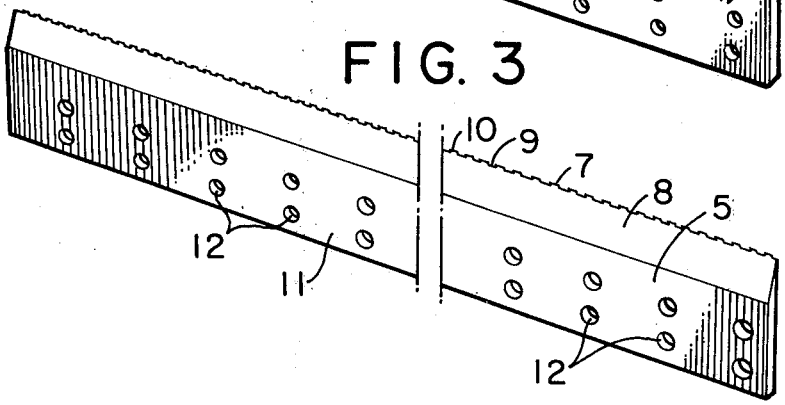
FIG. 3 is a perspective view of the cutter of this invention as seen from the front side.

Owing to the grooves 2, grooves 2 and lands 4 are alternately formed on the rear side of the cutter 1.

An inclined surface 8 for forming the sharp blade 7 is formed on the front side 5 of the cutter. The blade 7 which is thus constructed of the inclined surface 8 and the cutter rear 6 formed with the grooves 2 and lands 4 become such a shape that indentations and teeth 9 and 10 in the depth direction of the blade are alternately contiguous. At this time, the fore ends of the grooves 2 on the rear 6 define the indentations 9 of the blade 7, while those of the lands 4 define the teeth 10. The indentations and teeth 9 and 10 are arranged rectilinearly when viewed in the direction of arrow B in FIG. 7, and form sharp blade 7.

In the present embodiment, the grooves 2 formed on the cutter rear 6 incline at an angle of about 45°, and the opposite end parts of the lands 4 are cut gradually so as to be even with the plane of the grooves 2. The angle of the grooves 2 appear as the angle of grooves which are to be formed at the back of a brochure. The grooves 2 may well be formed at right angles to the face of the blade without bestowing the inclination angle thereon as in the present embodiment. In this case, the back of the brochure is formed with grooves perpendicular to the thickness of the brochure.

A plurality of bolt holes 12 are provided at the opposite part 11 of the cutter 1 remote from the cutting edge of blade 7.

The cutter of this invention having the above construction is mounted on the known cutting machine by inserting bolts into the bolt holes 12. The cutting machine moves the cutter 1 up and down in parallel with the inclination angle of the grooves 2 on the rear of the cutter. For example, in case where the angle of the grooves 2 is 45°, the cutter is moved up and down obliquely at the angle of 45°. When the conventional cutting machine capable of freely altering and adjusting the angle of the oblique ascent and descent motion of a cutter is employed, the use of the cutter of this invention is convenient.

As set forth above, this invention consists in a cutter for a cutting machine in which a large number of parallel grooves to define grooves and lands in the thickness direction and indentation and teeth in the depth direction of a blade are formed at equal intervals on the rear of the cutter. With the single cutter, it is possible to cut stacked sheets of paper into book blocks of a predetermined size and simultaneously form groove portions at the back parts of the book blocks by means of the sharp blade of the cutter. This achieves such effects that the operations of the production of brochures can be simplified and that the production efficiency of brochures can be enhanced to reduce the cost thereof.

What I claim is:

1. In a cutter which is mounted on a cutting machine for producing brochures, the cutter being moved obliquely and downwards, a cutter comprising:

a large number of parallel, grooves and lands formed on a rear side of said cutter and at equal intervals in a manner to extend towards an edge of said cutter and to be slant at an angle of substantially 45° relative to said edge, an inclined surface which is formed on a front side of said cutter in a manner to incline towards said edge, and a sharp blade which is formed of said grooves and lands on the rear and said inclined surface on the front and which is formed with teeth and indentations of said blade, and cutter edge ends of said grooves on the rear and said indentations of said blade being formed on a straight line.

2. A cutter for a cutting machine for producing brochures, the cutter being mounted for oblique linear downward and upward movement, said cutter comprising:

(a) an elongated blade having generally parallel planar front and rear surfaces defining a blade thickness therebetween;

(b) an inclined portion on said front surface defining a sharpened cutting edge along one longitudinal edge of the blade;

(c) a plurality of equally spaced grooves and lands on said rear surface extending in the thickness direction of the blade from the central part of said rear surface to said sharpened cutting edge, said grooves being at an angle of about 45° to said edge; and (d) a plurality of regularly spaced teeth and indentations on said sharpened edge extending in the depth direction thereof, said teeth and indentations being arranged so that a substantially straight line cutting edge is formed.

* * * * *